US007241121B2

(12) United States Patent
Matsushima

(10) Patent No.: US 7,241,121 B2
(45) Date of Patent: Jul. 10, 2007

(54) SCROLL FLUID MACHINE

(75) Inventor: Shinji Matsushima, Yokohama (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 11/425,760

(22) Filed: Jun. 22, 2006

(65) Prior Publication Data

US 2006/0233656 A1 Oct. 19, 2006

Related U.S. Application Data

(62) Division of application No. 10/850,639, filed on May 21, 2004.

(30) Foreign Application Priority Data

May 23, 2003 (JP) ..... 2003-146608

(51) Int. Cl.
*F04C 18/00* (2006.01)
*F03C 2/00* (2006.01)

(52) U.S. Cl. ..... 418/60; 418/55.1; 418/83; 418/99; 418/101; 165/86; 165/104.21

(58) Field of Classification Search ..... 418/60, 418/63, 55.1–55.5, 57, 99, 101, 83; 165/104.21, 165/86
See application file for complete search history.

(56) References Cited

U.S. PATENT DOCUMENTS 3,842,596 A 10/1974 Gray
5,101,888 A 4/1992 Sprouse et al.
5,417,554 A * 5/1995 Kietzman et al. ..... 418/101
5,842,843 A 12/1998 Haga
6,093,005 A * 7/2000 Nakamura ..... 418/55.1
6,123,529 A * 9/2000 Kawano et al. ..... 418/55.1

FOREIGN PATENT DOCUMENTS

DE 003810052 A1 10/1988
JP 358035389 A 3/1983
JP 10026090 A * 1/1998
JP 2000345972 A 12/2000

* cited by examiner

*Primary Examiner*—Theresa Trieu

(57) ABSTRACT

A scroll fluid machine has a fixed scroll in a housing and an orbiting scroll rotatably mounted to a driving shaft. A fixed wrap of the fixed scroll is engaged with an orbiting wrap of the orbiting scroll. The orbiting scroll is revolved at a certain eccentricity by the driving shaft, so that a gas sucked through the circumference of the housing is compressed as it moves toward the center, and discharged through the center. A gas-guiding bore is formed near the center of the orbiting scroll, and a heat-releasing rod is inserted in the bore. One end of the heat-releasing rod is projected from the fixed scroll to release heat to atmosphere.

2 Claims, 2 Drawing Sheets

SCROLL FLUID MACHINE

This application is a division of application Ser. No. 10/850,639 filed May 21, 2004.

BACKGROUND OF THE INVENTION

The present invention relates to a scroll fluid machine, and particularly to a scroll fluid machine, such as a scroll vacuum pump or a scroll pressurizing machine, in which a fixed wrap of a fixed scroll in a housing is engaged with an orbiting wrap of an orbiting scroll rotatably connected to an eccentric axial portion of a driving shaft, the orbiting scroll being revolved at a certain eccentricity by the driving shaft, thereby compressing a gas sucked from the circumference or the center of the housing as it moves toward the center or circumference and being discharged.

Such a scroll fluid machine is known among persons skilled in the art.

A scroll fluid machine runs for a long time, so that temperatures of a driving shaft, an eccentric axial portion of the driving shaft, bearings and packings rise to result in damage in the bearings and packings or in leak of lubricating oil. Hence it makes the machine impossible to use.

To increase durability of the scroll fluid machine, it is necessary to avoid excessive high temperature on the eccentric axial portion of the driving shaft during long-time operation.

To comply with such requirements, the following measures are taken and known among persons skilled in the art.

(1) Low or room temperature air or nitrogen is introduced into a compressing portion of a scroll fluid machine to dilute toxicity in the compressing portion.

(2) A gas-guiding bore is axially formed in a driving shaft, and a low or room temperature air or nitrogen is discharged through the gas-guiding bore. After it passes through the bearing, it is introduced into the compressing portion, which is cooled by the air or nitrogen which is discharged.

(3) An eccentric axial portion of the driving shaft is formed as hollow into which low or room temperature air is introduced to cool the eccentric axial portion.

However there are disadvantages as below in the foregoing measures.

In order to introduce low or room temperature air or nitrogen into the compressing portion, it is necessary to provide introducing paths and outside supply means. Thus, the structure becomes complicate and makes its size larger to result in high cost.

A gas-guiding bore is axially formed in a driving shaft, and low or room temperature air or nitrogen is discharged through the gas-guiding bore by centrifugal force caused by rotation of the driving shaft to cool bearings. In this device, when the driving shaft stops, a toxic or foreign-substance-containing gas in a compressing portion runs back and is discharged to atmosphere through the gas-guiding bore, thereby causing contamination in atmosphere.

SUMMARY OF THE INVENTION

In view of the foregoing disadvantages, it is an object of the present invention to provide a scroll fluid machine in which air is introduced through the circumference of a housing during operation to cool an eccentric axial portion of a driving shaft, bearing therefor and other members automatically to increase durability.

BRIEF DESCRIPTION OF THE DRAWINGS

The above and other features and advantages of the invention will become more apparent from the following description with respect to embodiments as shown in appended drawings wherein.

DETAILED DESCRIPTION OF PREFERRED EMBODIMENTS

Figure 1:
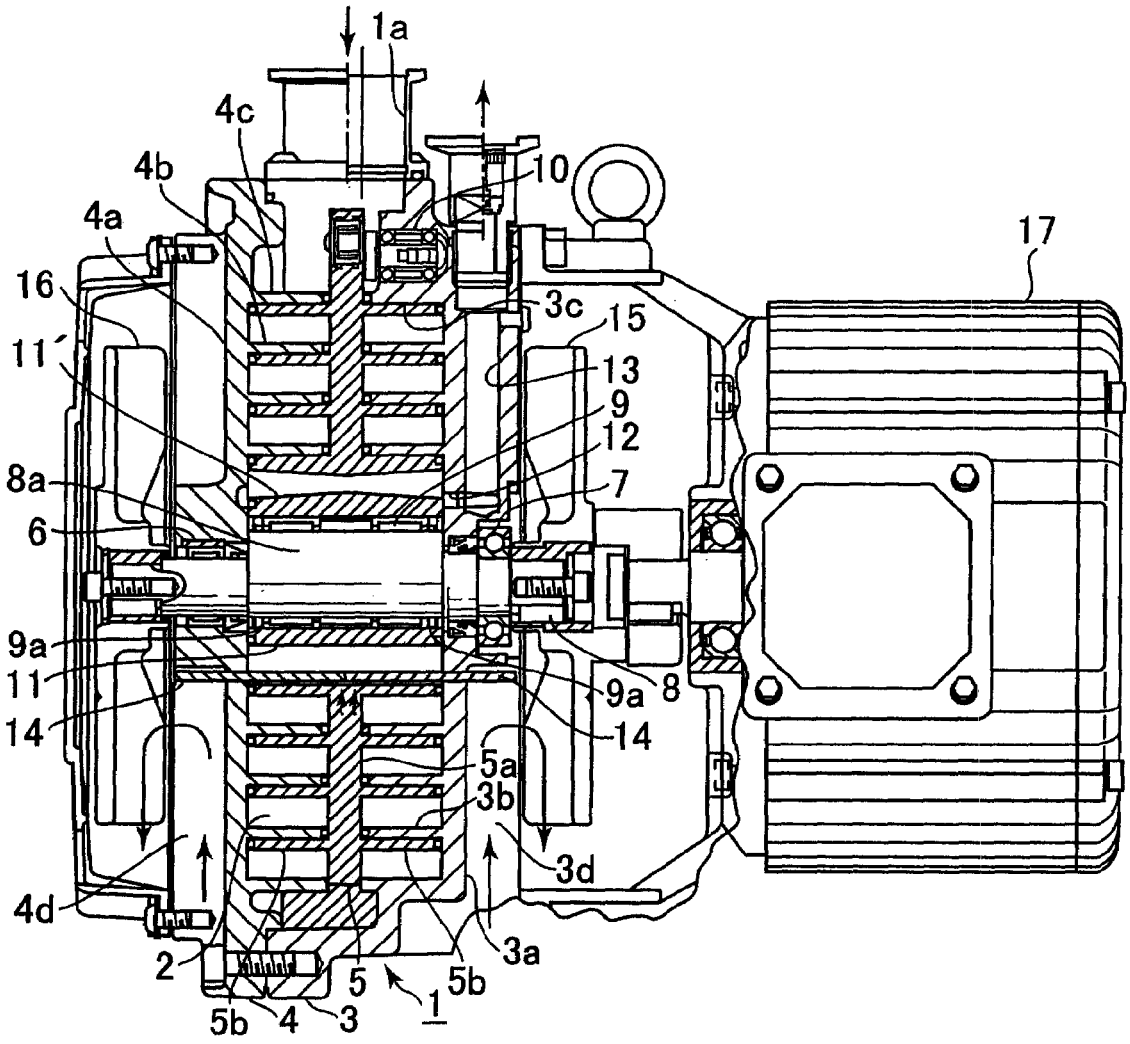
FIG. 1 is a vertical sectional side view of an embodiment of a scroll fluid machine according to the present invention.

FIG. 1 is a vertical sectional side view of one embodiment of a scroll fluid machine or a scroll vacuum pump according to the present invention, in which an orbiting scroll is revolved at a certain eccentricity, so that a gas through the circumference of a housing is sucked into a compressing portion between the orbiting scroll and a fixed scroll, compressed as it moves toward the center and discharged through the center.

The numeral 1 denotes a housing having a closed disc-like compression chamber 2, and comprises a casing 3 and a cover 4, a sucking bore 1*a* being formed on the circumference.

The housing 3 and cover 4 have fixed end plates 3*a* and 4*a* which surround the compression chamber 2 and oppose each other. Fixed wraps 3*b* and 4*b* are provided towards the compression chamber 2 to form the fixed scrolls 3*c* and 4*c*.

A plurality of cooling radial fins 3*d* and 4*d* are provided on the outer sides of the fixed end plates 4*a* and 4*a*. Between the fixed end plates 3*a* and 4*a* in the compression chamber 2, the orbiting scroll 5 is provided to revolve around an axis of the compression chamber 2.

The orbiting scroll 5 has an orbiting end plate 5*a* each surface of which has orbiting wraps 5*b*,5*b* engaged with the fixed scrolls 3*c*,4*c*, deviating by 180 degrees, and is rotatably supported on an eccentric axial portion 8*a* of a driving shaft 8 via a needle bearing 9 and a packing 9*a*. The driving shaft 8 is provided with bearings 6,7 in the center of the housing 1.

The orbiting end plate 5*a* is engaged with the fixed end plate 3*a* via three known pin-crank rotation preventing mechanisms 10 spaced uniformly on the circumference. As the driving shaft 8 rotates, the orbiting end plate 5*a* eccentrically revolves in the compression chamber 2 to change radial space between the fixed wraps 3*b*,4*b* and orbiting wraps 5*b*,5*b* engaged with each other.

A plurality of axial gas-guiding bores 11,11 are formed near the center of the orbiting end plate 5*a*. The gas-guiding bore 11 above the eccentric axial portion 8*a* functions as compressed gas path and communicates at one end with a discharge bore 13 formed inwardly from the circumference of the fixed end plate 3*a* via an axial communicating bore 12 near the center of the fixed end plate 3*a*.

Two heat pipes 14,14 disposed in series are inserted as a heat-releasing rod into the gas-guiding bore 1 under the eccentric axial portion 8*a* in FIG. 1, and the outer end of each of the heat pipes 14 passes through the fixed end plates 3*a* and 4*a* and extends over approximately whole axial length of the cooling fins 3*d*,4*d* near the inner end of the cooling fins 3*d*,4*d*.

Thus, projecting portions of the heat pipes 14 from the fixed end plates 3*a* and 4*a* communicate with atmosphere via a plurality of fins 3*d*,4*d*.

The driving shaft 8 has cooling fans 15,16 at the ends which extend from the fixed end plates 3*a*,4*a*. The cooling fans 15,15 sucks air towards the center via the fins 3*d*,4*d* and discharge it away from the center.

When the driving shaft 8 is rotated by a motor 17, the orbiting scroll 5 rotatably mounted to the driving shaft 8 is revolved at a certain eccentricity while it is engaged with the fixed scroll 3*c*,4*c*, and air sucked through the sucking bore 1*a* is compressed as it comes towards the center, thereby raising temperature. Thus, the inner ends of the heat pipes 14,14 in the gas-guiding bore 11 near the center of the orbiting scroll 5 are heated.

However, the outer ends of the heat pipes 14,14 are projected from the fixed scrolls 3*c*,4*c* and cooled with the cooling fans 15,16 by air which flows via the cooling fins 3*d*,4*d* and circulates. So heat in the inner end of the heat pipe 14 or the orbiting scroll 5 is effectively released, thereby preventing excessive rise in temperature at the center of the orbiting scroll 5. Furthermore, the needle bearing 9 and packing 9*a* are not damaged with heat or enclosed grease is prevented from flowing out.

Instead of the heat pipe 14, heat-releasing rod, tube or plate made of high heat-conductive material such as Cu is made as heat-releasing rod and inserted into the gas-guiding bore 11. The outer ends are projected from the fixed end plates 3*a* and 4*a* and cooled with atmosphere. The protecting portions of the rod-like releasing material from the fixed end plates 3*a*,4*a* are made as flat as possible or as thin as possible, or a number of notches or wave-shape is formed to increase heat releasing effect.

Figure 2:
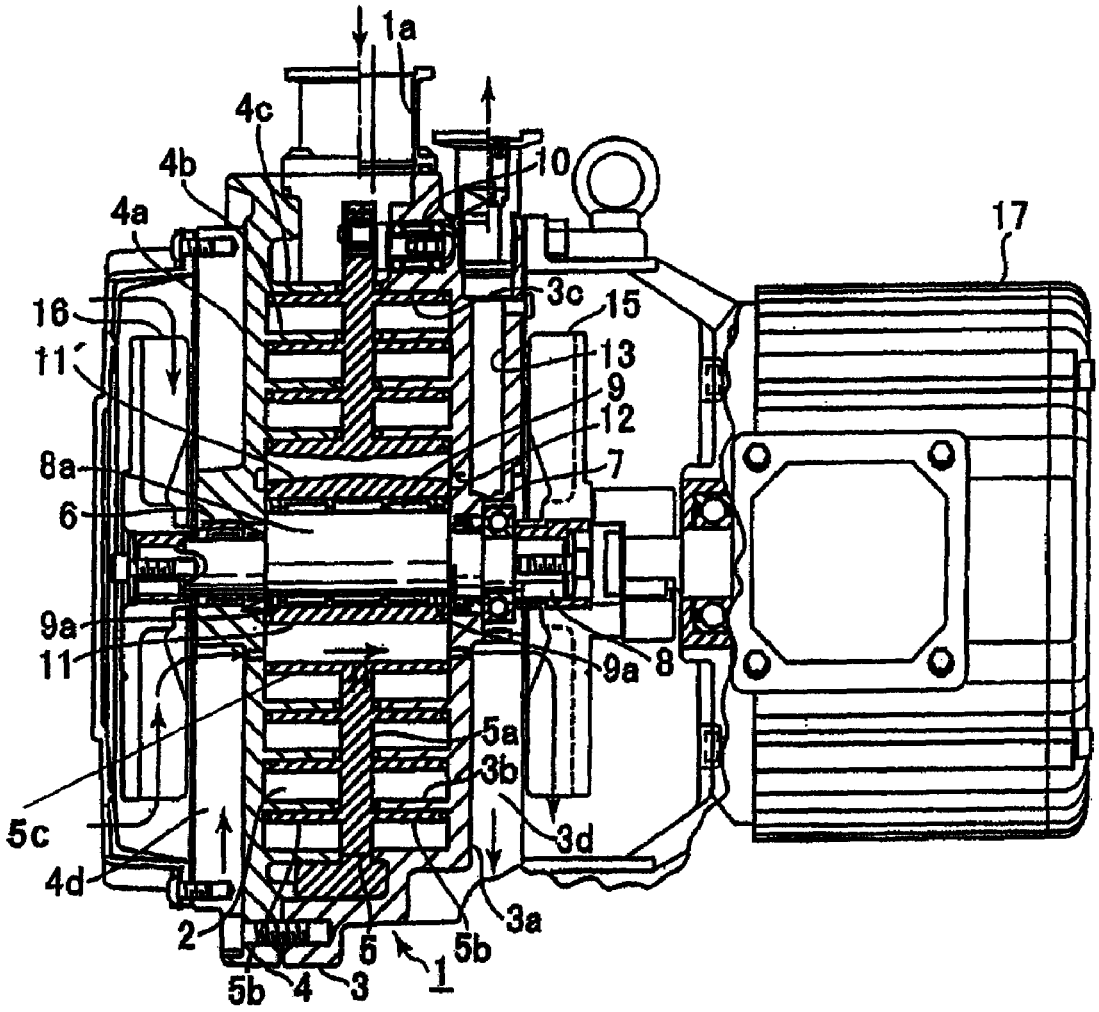
FIG. 2 is a vertical sectional side view of another embodiment of a scroll fluid machine according to the present invention.

FIG. 2 illustrates another embodiment of a scroll fluid machine, in which the same numerals are allotted to the same members as those in FIG. 1 and description therefor is omitted.

In FIG. 2, with nothing in a gas-guiding bore 11, cooling fans 15,16 with opposite pitches are rotated by a motor 17 to generate gas flow in a certain axial direction. The gas-guiding bore 11 is formed in a boss 5*c* of an orbiting scroll 5. Air is sucked from one end of the gas-guiding bore 11 by cooling fans 15,15 and discharged through the other end of the gas-guiding bore 11 after the gas-guiding bore 11 is effectively cooled. In addition to such device in which gas flow is generated in one axial direction, a heat pipe 14 or heat-releasing material as above is provided in the gas-guiding bore 11 hereby achieving more advantageous effect.

The foregoing embodiments relate to a both-side scroll fluid machine in which both-side orbiting scrolls are provided between two fixed scrolls, but the present invention is also applied to a one-side scroll fluid machine in which a one-side orbiting scroll is engaged with a one-side fixed scroll.

The foregoing merely relates to embodiments of the invention. Various changes and modifications may be made by a person skilled in the art without departing from the scope of claims wherein.

What is claimed is:

1. A scroll fluid machine comprising:

a housing;

a driving shaft having an eccentric axial portion;

a fixed scroll having a fixed wrap in the housing;

an orbiting scroll comprising a boss around an axis and an orbiting wrap extending circumferentially from the boss;

a bearing provided between the orbiting scroll and the eccentric axial portion of the driving shaft to allow the orbiting scroll to revolve around the eccentric axial portion by the driving shaft so that a gas sucked through a circumference of the housing is compressed as it moves toward a center of the orbiting scroll and discharged, a gas-guiding bore being formed axially in the orbiting scroll close to and radially outside the bearing in the boss of the orbiting scroll; and a cooling fan rotated by the driving shaft near an opening end of the gas-guiding bore, air flow generated by the cooling fan passing through the gas-guiding bore to reduce heat transfer of the compressed gas to the bearing to cool the bearing effectively.

2. A scroll fluid machine as claimed in claim 1 wherein the bearing comprises a needle bearing.

* * * * *